US006920831B2

(12) United States Patent
Lin

(10) Patent No.: US 6,920,831 B2
(45) Date of Patent: Jul. 26, 2005

(54) SHELF STRUCTURE

(76) Inventor: Chi-I Lin, 2F, No. 4, Alley 2, Lane 324, Sec. 4, Cheng-Kung Road, Taipei (TW)

( * ) Notice: Subject to any disclaimer, the term of this patent is extended or adjusted under 35 U.S.C. 154(b) by 97 days.

(21) Appl. No.: 10/603,622

(22) Filed: Jun. 26, 2003

(65) Prior Publication Data

US 2004/0084584 A1 May 6, 2004

(30) Foreign Application Priority Data

Jul. 1, 2002 (TW) ..... 91209941 U

(51) Int. Cl.[7] ..... A47D 11/00
(52) U.S. Cl. ..... 108/107; 211/187; 108/192
(58) Field of Search ..... 108/107, 193, 108/110, 192, 106, 153.1; 211/187, 189, 192, 195, 207

(56) References Cited

U.S. PATENT DOCUMENTS 1,366,743 A * 1/1921 O'Connor ..... 108/107
2,820,551 A * 1/1958 Mount ..... 108/107
4,513,669 A * 4/1985 Steinke ..... 108/107
4,607,576 A * 8/1986 Kranjec ..... 108/110
4,796,541 A * 1/1989 Halstrick ..... 108/107
4,996,929 A * 3/1991 Saal ..... 108/107
5,463,966 A * 11/1995 Nilsson ..... 108/110
6,814,245 B2 * 11/2004 Leclerc et al. ..... 211/187

FOREIGN PATENT DOCUMENTS

GB 2079586 A * 1/1982 ..... A47B/57/50
WO WO 8911238 A1 * 11/1989 ..... A47B/9/00

* cited by examiner

*Primary Examiner*—Jose V. Chen
(74) *Attorney, Agent, or Firm*—Troxell Law Office, PLLC

(57) ABSTRACT

A shelf including upright columns and first and second horizontally-extending bars having ends connected to the columns. The column has side walls each defining at least one first hole and forming a first rib adjacent the first hole. The first bar is arranged in a first horizontal direction with the end connected to the column. The end of the first bar forms an end tab in which at least one first hook is formed and fit into the first hole of one of the side walls. The first hook has a surface forming a second rib. The second rib receivingly engages the first rib to strength the connection between the end of the first bar and the column. The second bar is arranged in a second horizontal direction with the end connected to the column. The end of the second bar forms an end tab in which at least one second hook if formed and fit into the first hole of another one of the side walls. The second hook has a surface in which a third rib is formed. The third rib receivingly engages the first rib to strength the connection between the end of the second bar and the column.

10 Claims, 6 Drawing Sheets

SHELF STRUCTURE

FIELD OF THE INVENTION

The present invention generally relates to a shelf having a disassembleable structure, and in particular to a disassembleable shelf having a sound, secured, high strength and safe structure that can be efficiently assembled and disassembled.

BACKGROUND OF THE INVENTION

A conventional disassembleable shelf is comprised of upright columns and horizontal bars connected at both ends to the upright columns. An example of the conventional disassembleable shelf is shown in FIG. 1 of the attached drawings, wherein the shelf comprises upright and horizontal elongate members 6, including upright column and horizontal bar, having an L-shaped cross section, such as angled steel. Holes 7 are defined in the elongate members 6. In assembling the shelf, holes of the horizontal bar are aligned with holes of the upright column for the extension of bolts 7 therethrough. The bolts 7 secure the horizontal bar and the upright columns together to form a sound shelf structure.

Since tightening and loosening bolts is a time and labor consuming work, the conventional shelf illustrated in FIG. 1, although being disassembleable by the general consumers, requires a great amount of time and labor in doing assembly and disassembly.

FIG. 2 of the attached drawings shows another example of the conventional disassembleable shelf structure comprising upright columns 8 and horizontal bars 9. Holes 81 are defined in and spaced along the upright column 8. Hooks 91 are formed at ends of the horizontal bar 9 for fitting into and engaging the holes 81 of the upright column 8 thereby attaching the horizontal bar 9 to the upright column 8. Although the engagement of the hooks 91 with the holes 81 can be readily done for assembly of the shelf, due to clearance required for fitting the hook 91 into the corresponding hole 81, the structure of the shelf is in general not sound and shaking often occurs.

Thus, it is desired to have a disassembleable shelf having a sound structure and capable of efficient assembly/disassembly in order to overcome the deficiencies of the conventional disassembleable shelves.

SUMMARY OF THE INVENTION

A primary object of the present invention is to provide a disassembleable shelf having enhanced mechanical stability, security and strength, as well as safety of use.

Another object of the present invention is to provide a shelf structure that is capable of efficient disassembly and assembly.

A further object of the present invention is to provide a disassembleable shelf having a sound structure for supporting articles thereon.

To achieve the above objects, in accordance with the present invention, there is provided a shelf comprising upright columns and first and second horizontally extending bars having ends connected to the columns. The column comprises side walls each defining at least one first hole and forming a first rib adjacent the first hole. The first bar is arranged in a first horizontal direction with the end thereof connected to the column. The end of the first bar forms an end tab in which at least one first hook is formed and fit into the first hole of one of the side walls. The first hook has a surface forming a second rib. The second rib receivingly engages the first rib to strength the connection between the end of the first bar and the column. The second bar is arranged in a second horizontal direction with the end thereof connected to the column. The end of the second bar forms an end tab in which at least one second hook is formed and fit into the first hole of another one of the side walls. The second hook has a surface in which a third rib is formed. The third rib receivingly engages the first rib to strength the connection between the end of the second bar and the column. By means of the structure of the columns and bars, the shelf can be efficiently assembled/disassembled and has a structure of enhanced mechanical stability, security, safety and overall strength.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
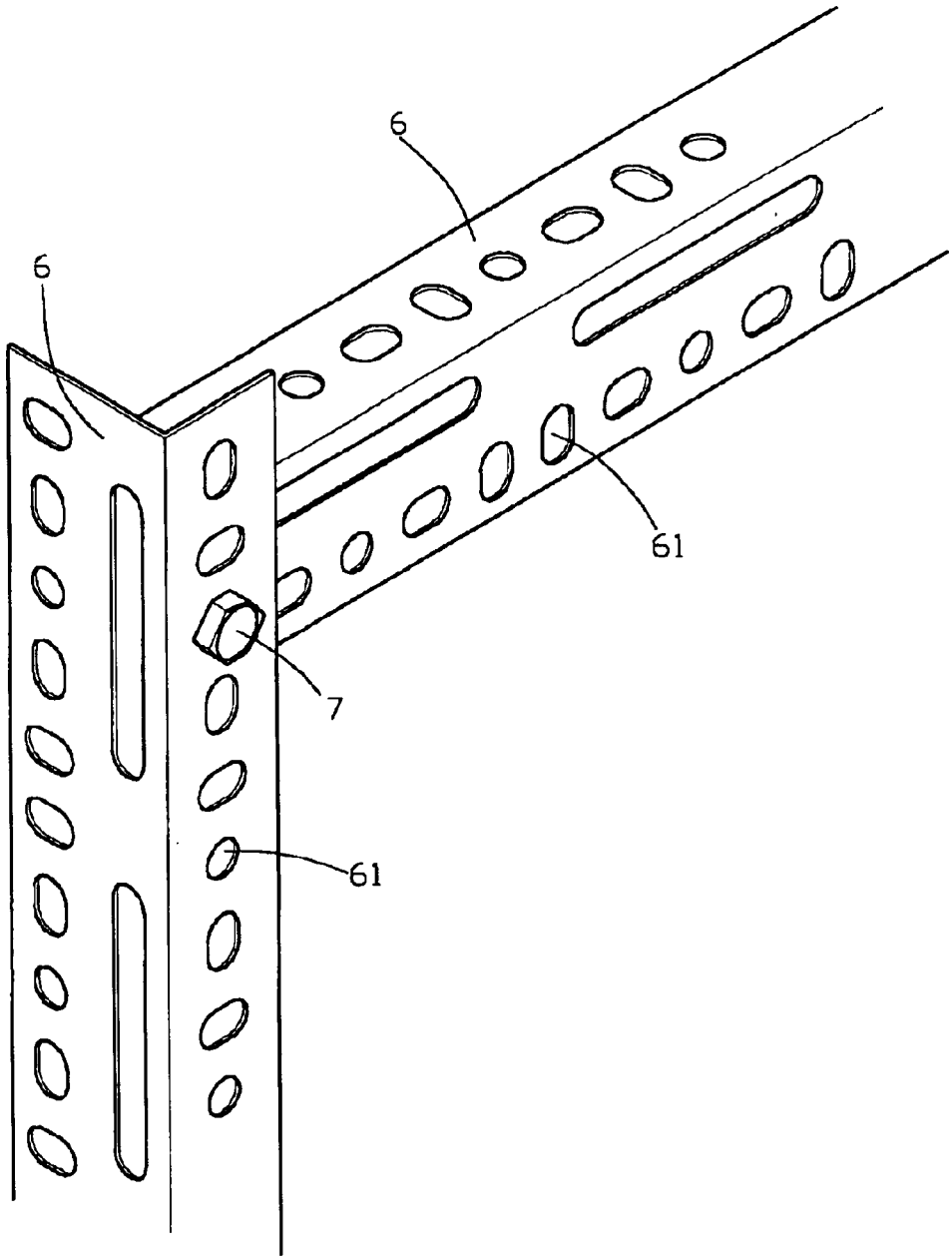
Fig. 1 (Prior Art)
FIG. 1 is a perspective view of a portion of a conventional disassembleable shelf structure.
Figure 2:
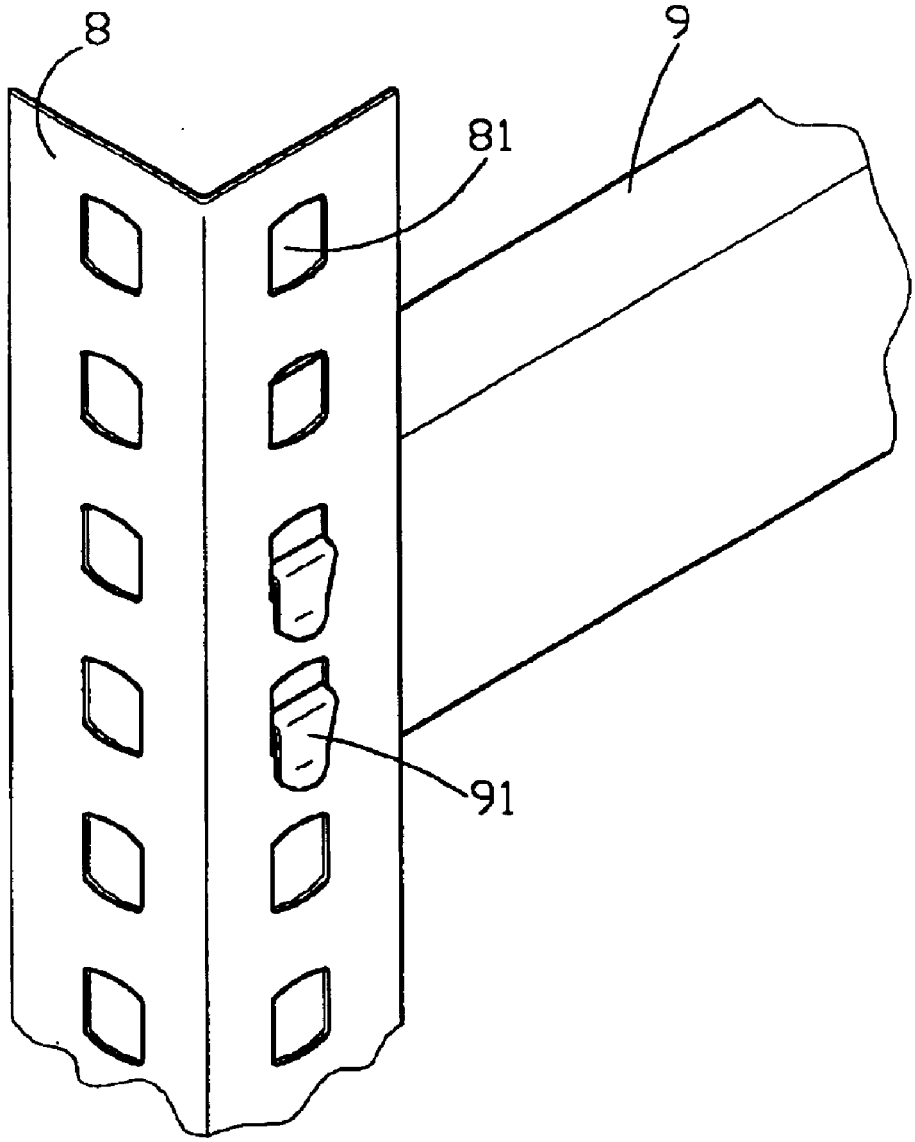
Fig. 2 (Prior Art)
FIG. 2 is a perspective view of a portion of another conventional disassembleable shelf structure.
Figure 3:
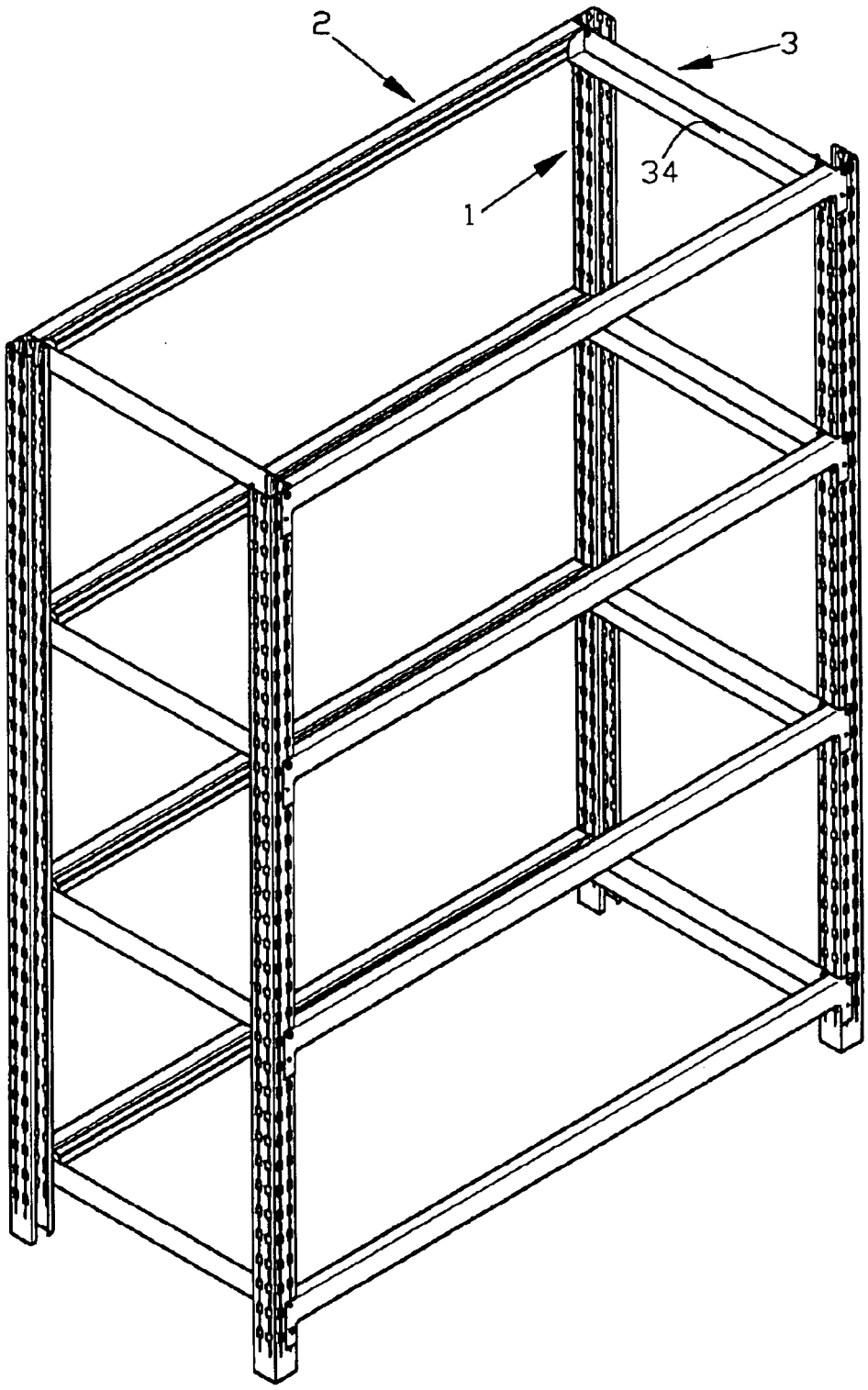
FIG. 3 is a perspective view of a disassembleable shelf constructed in accordance with the present invention.

With reference to the drawings and in particular to FIG. 3, a shelf constructed in accordance with the present invention comprises a number of upright or vertical columns 1 and longitudinal and transverse bars 2, 3 extending in horizontal directions and connected between adjacent columns 1. In the embodiment illustrated, the shelf comprises four columns 1 arranged at four comers of a rectangle and four sets of bars 2, 3 are mounted to and connected with the columns 1 in a spaced manner along the vertical direction whereby four levels are formed in the shelf. Each set of bars comprises two longitudinal bars 2 opposite to each other and each connected between two adjacent columns 1 and two transverse bars 3 opposite to each other and each connected between adjacent columns 1 whereby the longitudinal and transverse bars 2, 3 form a rectangle with the columns 1 located at the comers. However, it is apparent to those having ordinary skills to arrange the columns 1 and the bars 2, 3 in different ways to form different shelf configurations.

Figure 4:
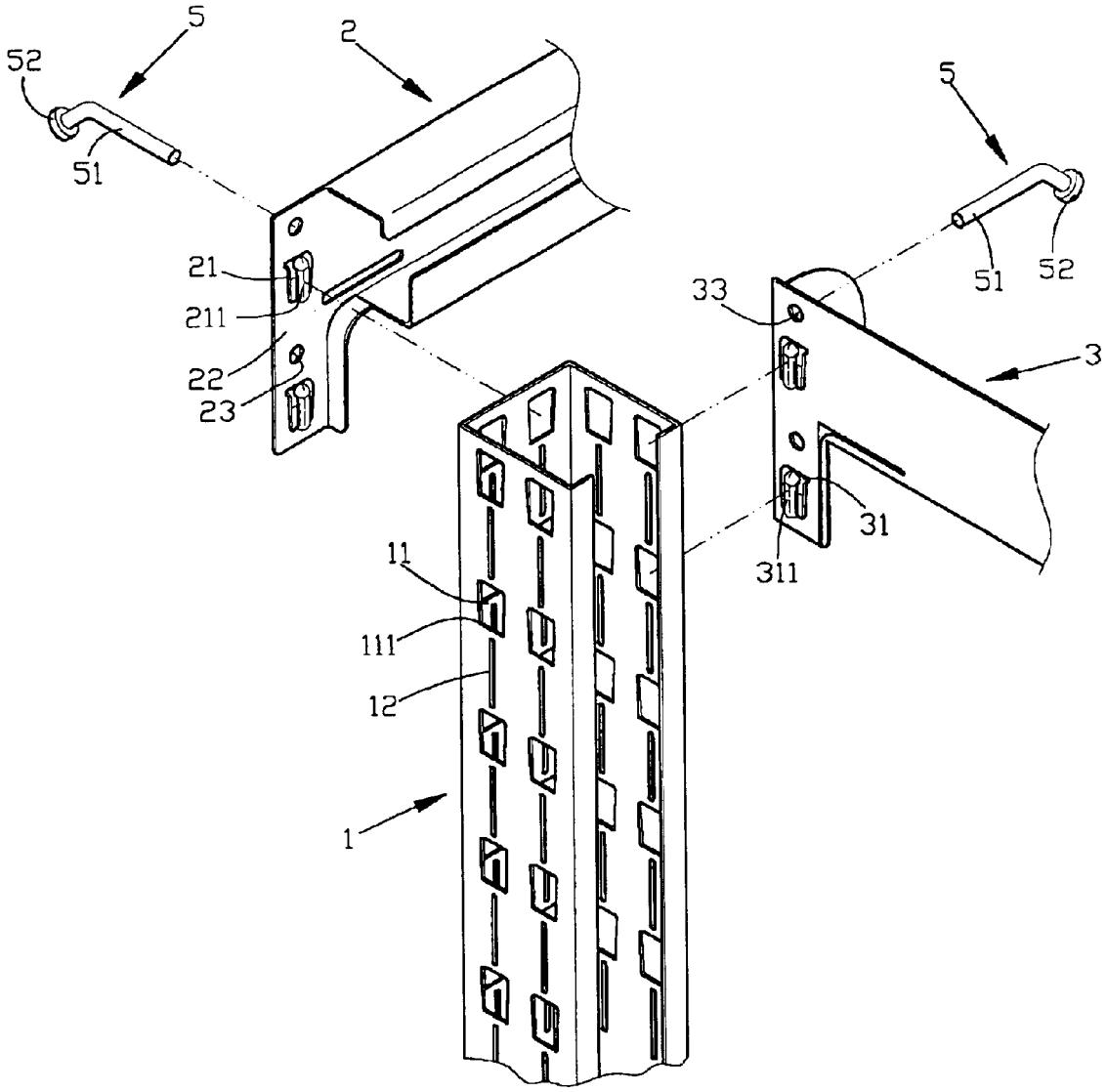
FIG. 4 is an exploded view of a portion of the disassembleable shelf of the present invention.
Figure 5:
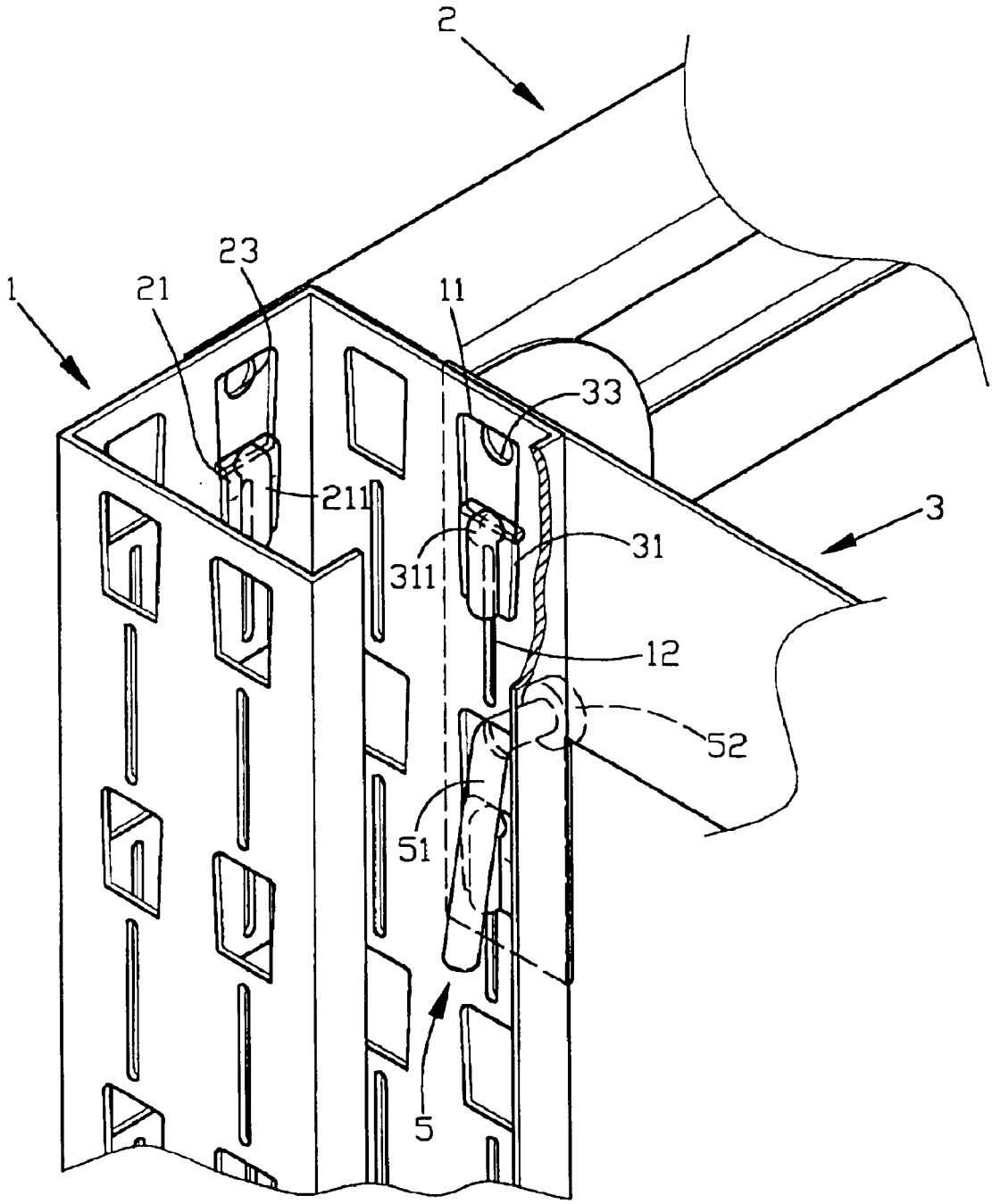
FIG. 5 is an assembled view of FIG. 4.

Also referring to FIGS. 4 and 5, each column 1 has at least two side walls (not labeled) connected to each other. The column 1 has three side walls in the embodiment illustrated. A plurality of holes 11 is defined in each side wall and spaced in a line along the column whereby a predetermined distance is present between adjacent holes 11. A raised, reinforcing rib 12 is formed on the side wall of the column 1 and extending between adjacent holes 11. The holes 11 have an inverted trapezoidal shape having a narrowed lower portion 111.

If desired, the holes 11 can be arranged in two lines, as shown in the drawings, or more lines.

The longitudinal bar 2 has opposite ends each forming an end tab 22 on which at least one hook 21 is formed. In the embodiment illustrated, each end tab 22 forms two hooks 21. The hook 21 is sized to fit into one of the holes 11 to attach the longitudinal bar 2 to the column 1. The hook 21 has a surface in which a recessed rib 211 is formed whereby when the hook 21 is fit into the hole 11, the recessed rib 211 of the hook 21 is fit over and thus receives the raised rib 12 of the column 1 thereby securely fixing the longitudinal bar 2 to the column 1. Connection between the end tab 22 and the column 1 is enhanced. The end tab 22 also defines a securing hole 23 adjacent each hook 211 whereby when the hook 211 is fit into one of the holes 11, the securing hole 23 substantially aligns with a next one of the holes 11. This will be further described.

The transverse bar 3 has opposite ends each forming an end tab 32 on which at least one hook 31 is formed. In the embodiment illustrated, each end tab 32 forms two hooks 31. The hook 31 is sized to fit into one of the holes 11 to attach the transverse bar 3 to the column 1. The hook 31 has a surface in which a recessed rib 311 is formed whereby when the hook 31 is fit into the hole 11, the recessed rib 311 of the hook 31 is fit over and thus receives the raised rib 12 of the column 1 thereby securely fixing the transverse bar 3 to the column 1. Connection between the end tab 32 and the column 1 is enhanced. The end tab 32 also defines a securing hole 33 adjacent each hook 311 whereby when the hook 311 is fit into one of the holes 11, the securing hole 33 substantially aligns with a next one of the holes 11. This will be further described.

Figure 6:
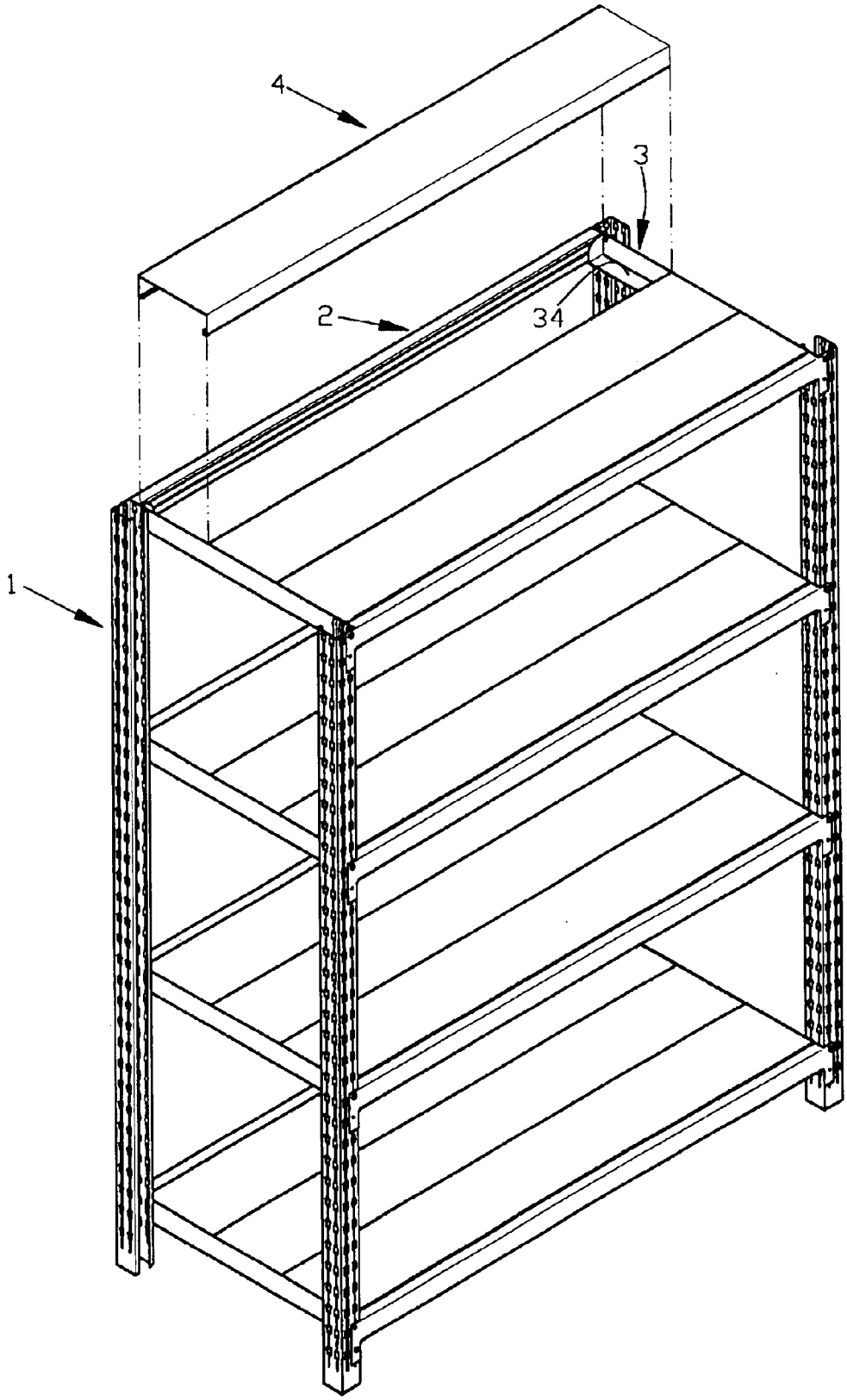
FIG. 6 is a perspective view of the disassembleable shelf of the present invention on which article support boards are mounted.

Also referring to FIG. 6, the transverse bar 3 forms a support flange 34 facing toward the opposite transverse bar 3. Boards 4 for supporting articles (not shown) thereon are positioned on and supported by the support flanges 35 at opposite ends of the boards 4.

To assemble the shelf, the hooks 21 of the longitudinal bars 2 are fit into the corresponding holes 11 of the columns 1. Due to the trapezoidal shape of the holes 11, when the hooks 21 are forced toward the narrowed lower portions 111 of the holes 11, the hooks 21 are securely and tightly fixed by the narrowed lower portions 111 of the holes 11. Similarly, the hooks 31 of the transverse bars 3 are fit into the corresponding holes 11 of the columns 1 and are securely and tightly fixed in the narrowed lower portions 111 of the holes 11. Meanwhile, the recessed ribs 211, 311 of the bars 2, 3 snugly engage the raised ribs 11 of the columns 1 to firmly fix the bars 2, 3 to the columns 1. Thus, shaking and vibration of the shelf do not occur easily. All sets of the bars 2, 3 are mounted to the columns 1 in the same manner. Upon completely mounting the bars 2, 3 to the columns 1, the boards 4 are positioned on the support flanges 34 of the transverse bars 3 to complete the assembly of the shelf. It is apparent to those having ordinary skills to arrange and fix the columns 1, the longitudinal bars 2 and the transverse bars 3 in different ways to form different configurations of shelf for matching with different requirements and desires.

Optionally, to more securely fix the bars 2, 3 to the columns 1, a pin 5 is fit into the securing hole 23, 33 of the bars 2, 3 and extends through the corresponding hole 11 of the column 1. The pin 5 has an L-shaped body 51 and comprises an expanded portion 52 formed at an end of the L-shaped body 51. A first section of the L-shaped body 51 extends through the securing hole 23, 33 and the hole 11 first in a direction substantially normal to the side wall of the column 1. After the first section completely passes through the securing hole 23, 33 and the hole 11, a second section of the L-shaped body 51 enters the securing hole 23, 33 and the hole 11 to have the first section substantially parallel with and adjacent to the side wall of the column 1. The expanded portion 52 that is formed at a free end of the second section of the L-shaped body 51 and has a size larger than the securing holes 23, 33, cooperating with the first section, retains the pin 5 in position and prevents the pin 5 from detaching from the holes 23 (33), 11. By means of the simple insertion of the pin 5 through the holes 23 (33), 11, no bolt is required to strengthen the connection between the bars 2, 3 and the columns 1. Mechanical stability of the shelf can also be enhanced. Assembly and disassembly of the shelf can be performed readily.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A shelf comprising upright columns and first and second horizontally-extending bars having ends connected to the columns and the improvements comprising:

the column comprising at least first and second side walls each of the first and second side walls having at least one first hole, a first rib being formed on the side wall adjacent each of the at least one first hole;

the first bar being arranged in a first horizontal direction with an end thereof connected to the first side wall of the column, the end of the first bar forming an end tab having at least one first hook formed and sized to fit into a first side wall hole of the at least one the first hole of the first side wall, the first hook comprising a surface having a second rib receivingly engaging the first rib adjacent to the first side wall hole to strengthen a connection between the end of the first bar and the column;

the second bar being arranged in a second horizontal direction with an end thereof connected to the second side wall of the column, the end of the second bar forming an end tab having at least one second hook formed and sized to fit into a second side wall hole of the at least one first hole of the second side wall, the second hook comprising a surface having a third rib receivingly engaging the first rib adjacent to the second side wall hole to strengthen a connection between the end of the second bar and the column, the second bar forming a support flange.

2. The self as claimed in claim 1, wherein the side wall defines a plurality of first holes adjacent to and spaced from each other, each of the at least one first hole of the first side wall is adjacent to and spaced from one of the at least one first hole of the second side wall.

3. The shelf as claimed in claim 1, wherein the first hole has an inverted trapezoidal shape having a narrowed lower portion.

4. The shelf as claimed in claim 1, wherein the first rib of the column is raised.

5. The shelf as claimed in claim 1, wherein the second rib of the first hook of the first bar is recessed.

6. The shelf as claimed in claim 1, wherein the third rib of the second hook of the second bar is recessed.

7. The shelf as claimed in claim 1 further comprising at least one positioned on and supported by the support flanges of the second bars.

8. The shelf as claimed in claim 1, wherein the end tabs of the first and second bars each define a second hole whereby when the first and second hooks of the first and second bars are fit into the first holes, the second holes align with next ones of the first holes.

9. The shelf as claimed in claim 8 further comprising a pin extending through each of the second holes and the associated first hole.

10. The shelf as claimed in claim 9, wherein the pin comprises an L-shaped body and an expanded portion formed at an end of the L-shaped body, the expanded portion being larger than the second hole.

* * * * *